US007806741B1

(12) United States Patent
Baier et al.

(10) Patent No.: US 7,806,741 B1
(45) Date of Patent: Oct. 5, 2010

(54) MARINE PROPULSION SYSTEM WITH SEPARATE AIR INTAKE AND COOLING SYSTEMS

(75) Inventors: Mark A. Baier, Oshkosh, WI (US); Brad Van Ruiswyk, Waupun, WI (US); John D. Skroski, Oshkosh, WI (US); John A. Bauer, Wautoma, WI (US)

(73) Assignee: Brunswick Corporation, Lake Forest, IL (US)

( * ) Notice: Subject to any disclaimer, the term of this patent is extended or adjusted under 35 U.S.C. 154(b) by 36 days.

(21) Appl. No.: 12/369,020

(22) Filed: Feb. 11, 2009

(51) Int. Cl.
*B63B 35/73* (2006.01)

(52) U.S. Cl. ..... 440/88 A; 440/77; 440/88 C

(58) Field of Classification Search ..... 440/76, 440/77, 88 A, 88 C, 88 R
See application file for complete search history.

(56) References Cited

U.S. PATENT DOCUMENTS

| | | | | |
|---|---|---|---|---|
| 4,952,180 | A * | 8/1990 | Watanabe et al. | 440/77 |
| 5,176,551 | A | 1/1993 | Blanchard et al. | |
| 5,340,343 | A * | 8/1994 | Kawamukai et al. | 440/77 |
| 5,445,547 | A | 8/1995 | Furukawa | |
| 5,713,772 | A | 2/1998 | Takahashi et al. | |
| 5,899,778 | A | 5/1999 | Hiraoka et al. | |
| 5,937,818 | A | 8/1999 | Kawai et al. | |
| 5,992,368 | A | 11/1999 | Okamoto | |
| 6,132,273 | A | 10/2000 | Nakayama et al. | |
| 6,183,323 | B1 | 2/2001 | Tanaka et al. | |
| 6,302,749 | B1 * | 10/2001 | Tawa et al. | 440/76 |
| 6,358,105 | B1 * | 3/2002 | Isogawa et al. | 440/77 |
| 6,413,131 | B1 | 7/2002 | Phillips et al. | |
| 6,623,319 | B2 | 9/2003 | Isogawa | |
| 6,899,579 | B1 | 5/2005 | Bruestle | |
| 7,021,262 | B1 | 4/2006 | Belter et al. | |
| 7,238,068 | B2 | 7/2007 | Nagashima et al. | |
| 7,252,568 | B2 * | 8/2007 | Ito et al. | 440/77 |
| 7,267,591 | B2 * | 9/2007 | Kimura et al. | 440/77 |
| 7,299,783 | B1 | 11/2007 | Broman et al. | |
| 7,401,598 | B2 | 7/2008 | Ochiai | |
| 7,524,223 | B2 * | 4/2009 | Ochiai et al. | 440/88 R |
| 2005/0079775 | A1 * | 4/2005 | Katayama | 440/77 |

* cited by examiner

*Primary Examiner*—Lars A Olson
(74) *Attorney, Agent, or Firm*—William D. Lanyi

(57) ABSTRACT

An outboard motor is provided with two distinct and separate streams of air flowing through its cowl structure. One stream of air is intended to cool various heat emitting components under the cowl and the other stream of air is intended to provide required air for combustion within the cylinders of the engine. The two streams of air flow along first and second flow paths which are maintained in isolation with respect to each other so that the air in the two streams of air are not mixed together. In that way, heat is prevented from decreasing the density of the air stream flowing into the cylinders for combustion within the engine.

15 Claims, 5 Drawing Sheets

MARINE PROPULSION SYSTEM WITH SEPARATE AIR INTAKE AND COOLING SYSTEMS

BACKGROUND OF THE INVENTION

1. Field of the Invention

The present invention is generally related to an outboard motor and, more particularly, to an outboard motor that utilizes two independent and isolated air management systems to provide cooling air that flows over the engine and other heat emitting components and independently direct a stream of air into an air intake manifold of the engine.

2. Description of the Related Art

Many types of marine propulsion systems use air for two distinctly different purposes. One purpose is to satisfy the basic requirement of the engine which ingests air for the purpose of supporting combustion within its cylinders. The other purpose is to remove heat from various heat generating components, such as the engine itself, the alternator, and other devices of the marine propulsion unit. The air management systems known to those skilled in the art sometimes direct cooling air into the cylinders of the engine after it has removed heat from the heat emitting components. Some air management systems use multiple air streams to satisfy these various purposes and cause the air to slow along predefined paths that sometimes cause the various air streams to mix and sometimes segregate them.

U.S. Pat. No. 5,176,551, which issued to Blanchard et al. on Jan. 5, 1993, describes an arrangement for supplying combustion air to an outboard motor. The apparatus comprises a boat including a wall extending generally in the fore and aft direction and having therein an air outlet opening, a propulsion unit mounted on the boat and including a propeller shaft, an engine drivingly connected to the propeller shaft, and a cover surrounding the engine and having therein an air inlet opening, and a duct communicating between the air outlet opening and the air inlet opening.

U.S. Pat. No. 5,445,547, which issued to Furukawa on Aug. 29, 1995, describes an outboard motor having an engine compartment covered by an engine cover at its top portion and having an engine disposed within the engine compartment with its crankshaft directed in a vertical direction. Charging efficiency of the engine is improved with a simple structure and a shielding property of the entire surrounding of the engine is also enhanced. A suction chamber communicating with an intake section of the engine is disposed on a surface other than the top surface of the engine and on one side of the inside of the engine compartment, an air intake port is provided in the engine cover at a position close to the other side of the inside of the engine compartment, an air exhaust port is provided in the engine cover, and a duct is provided within the engine compartment for leading air from the air intake port towards the suction chamber while making a detour to avoid a route above the engine.

U.S. Pat. No. 5,713,772, which issued to Takahashi et al. on Feb. 3, 1998, describes a cooling arrangement for an outboard motor. A number of embodiments of four cycle internal combustion engines have belt driven overhead cam shafts. The power head of the outboard motor includes a protective cowling that has an atmospheric air inlet and the air drawn through this atmospheric air inlet is directed over a timing belt that drives the cam shaft from the engine crankshaft for its cooling.

U.S. Pat. No. 5,899,778, which issued to Hiraoka et al. on May 4, 1999, describes an outboard motor induction system. The system for an outboard motor includes a cover extending over a top end of the engine. The cover defines an air duct leading from an intake chamber defined by the cowling to an intake pipe of the air intake system of the engine. The cover also defines an air duct in communication with the engine compartment and leading to an exhaust chamber defined by the cowling.

U.S. Pat. No. 5,937,818, which issued to Kawai et al. on Aug. 17, 1999, describes a ventilation system for an outboard motor. It has a water propulsion device and an internal combustion engine positioned in a cowling. The engine has an output shaft arranged to drive the water propulsion device. The ventilating system includes an air inlet in the cowling which permits air to flow into an engine compartment in which the engine is positioned. An exhaust port is to positioned in the cowling. The system also includes a mechanism for drawing air through the inlet into the compartment and expelling air out of the compartment through the exhaust port after the engine has stopped.

U.S. Pat. No. 5,992,368, which issued to Okamoto on Nov. 30, 1999, describes an induction system for an outboard motor. It has a cowling and a water propulsion device and the engine is positioned in the cowling and has an output shaft arranged to drive the water propulsion device. The engine has at least one combustion chamber and the induction system is arranged to provide air to each combustion chamber.

U.S. Pat. No. 6,132,273, which issued to Nakayama et al. on Oct. 17, 2000, describes a cowling for an outboard motor. It provides atmospheric air to the engine of an outboard motor for engine cooling and combustion while inhibiting water intake. The protective cowling incorporates one or more inlets, an air chamber, and ducts of different sizes for permitting atmospheric air to enter the engine compartment.

U.S. Pat. No. 6,183,323, which issued to Tanaka et al. on Feb. 6, 2001, describes an outboard marine drive powered by an air cooled internal combustion engine. The engine is received in an under case and is closed by both a fan cover and an engine cover so that the engine may be entirely covered by the engine cover jointly with the under case for a favorable aesthetic effect. However, the fan cover covers the engine closely in cooperation with the under case so that a narrow air passage is defined around the engine, and cooling air of high velocity can be continuously passed around the engine.

U.S. Pat. No. 6,413,131, which issued to Phillips et al. on Jul. 2, 2002, discloses an air flow system for an outboard motor. An outboard motor is provided with an air duct located within the cavity of a cowl of an outboard motor. The air duct defines a chamber within it in association with first and second openings that allow heated air to flow, through the creation of convection currents, out of the engine compartment under a cowl. This convection removes heat from the fuel system components and reduces the likelihood that vapor lock will occur subsequent to the use of the internal combustion engine that is followed by turning the engine off.

U.S. Pat. No. 6,623,319, which issued to Isogawa on Sep. 23, 2003, describes a cowling and ventilation system for an outboard motor. It includes a cowling substantially enclosing an engine therein. The engine has an air induction device for introducing air to a combustion chamber and an exhaust system for communicating exhaust products away from the combustion chamber. The air induction device has an intake opening near a front end of the engine. The cowling has an air inlet at a rear portion of the cowling. An air guide member is disposed between the cowling air inlet and an engine cover which is positioned atop the engine. The air guide member and engine cover cooperate to direct air toward a rear and center of the engine.

U.S. Pat. No. 6,899,579, which issued to Bruestle on May 31, 2005, discloses a marine propulsion device with variable air intake system. An air flow control mechanism is provided to control the flow of air through an opening formed in a portion of a cowl of an outboard motor. The air flow control mechanism is configured to be movable between a first position and a second position to affect the magnitude of air flowing through an air passage defined as being the space between the opening formed in the cowl and an exit through which the air can leave the cavity of the cowl. The air flow control mechanism can control the flow of air as a function of an operating characteristic of the engine, such as its operating speed, the load on the engine, or the operating temperature of the engine.

U.S. Pat. No. 7,021,262, which issued to Belter et al. on Apr. 4, 2006, discloses an undercowl plenum chamber with preferential air paths. An air intake system for an outboard motor provides parallel air flow paths between an opening formed in a cowl of the outboard motor and an air intake manifold of an engine under the cowl. A first air path flows in a relatively direct path between the opening in the cowl and the first inlet of a plenum chamber. A second air flow flows in a less direct path from the opening in the cowl to a second inlet of the plenum chamber. The second air flow is used to remove heat from a preselected component, such as an alternator, before it rejoins the first air flow within the cavity of the plenum chamber and is directed, in combination with the first air flow, through an intake air conduit connected to an outlet of the plenum chamber and to an air intake manifold of the engine.

U.S. Pat. No. 7,238,068, which issued to Nagashima et al. on Jul. 3, 2007, describes a boat and outboard motor having an air intake system. The boat includes an outboard motor having an internal combustion engine enclosed within a cowling. The cowling has a rear inlet port for allowing outside air to be drawn into the cowling. A closure member selectively closed the inlet port depending upon certain engine operating parameters. In another embodiment, the cowling also includes a front air inlet port, and a front closure device for selectively opening and closing the front inlet port.

U.S. Pat. No. 7,299,783, which issued to Broman et al. on Nov. 27, 2007, discloses an auxiliary control of air flow through an engine enclosure of an outboard motor. A marine propulsion device is provided with an air control system that draws air from a region under the cowl of the outboard motor and induces a flow of air out of the region. The air is caused to flow through a second opening formed in the cowl. As a result, air drawn into the cowl through a first opening can flow either into the engine through its throttle body mechanism or out of the space under the cowl, as induced by the operation of the fan.

U.S. Pat. No. 7,401,598, which issued to Ochiai on Jul. 22, 2008, describes an outboard motor with forward air intake and air-cooled fuel pump. An outboard motor can comprise a cowling for covering an engine, a high pressure fuel supply system, and a low pressure fuel supply system. The high pressure fuel supply system can have a vapor separator tank and a high pressure fuel pump. The low pressure fuel supply system can have a low pressure fuel pump. A heat insulating chamber, defined from a space for accommodating the engine, can be formed within the cowling. The heat insulating chamber houses the low pressure fuel pump in the fuel filter.

The patents described above are hereby expressly incorporated by reference in the description of the present invention.

As illustrated by the patents described above, those skilled in the art of marine propulsion devices are aware of many different techniques and systems that manage the air flow under the cowl of the marine propulsion device. Some systems provide an air inlet through a cowl wall which allows a stream of air to flow in thermal communication with an engine and other associated heat emitting components located under the cowl. That air can be directed to a throttle body of the engine and ingested for use in the combustion process within the engine. Some of the air can be directed through an air outlet opening in the cowl to remove heat from the internal cavity within the cowl. Fans have been used for the purpose of inducing the air flow within the cavity of the cowl. Of the many air management systems and methods for drawing air into the cavity of a cowl, ingesting air into the air intake manifold and cylinders of an engine, directing a flow of air over heat emitting components located under the cowl, and causing air to exit from the cavity under the cowl through an opening formed in the wall of the cowl, no known systems provide two completely isolated and segregated air streams which independently provide air for combustion within the engine and provide air in a cooling stream to remove heat from the engine and other components without mixing the two air streams. Since the purposes of an air induction system for an engine and an air cooling system for the engine are often mutually exclusive, it would be significantly beneficial if a marine propulsion device could be provided with two completely independent air streams that provide an air induction stream and a component cooling stream that do not interact.

SUMMARY OF THE INVENTION

A marine propulsion device made in accordance with a preferred embodiment of the present invention comprises a cowl defining a cavity, an engine having a plurality of cylinders, an air intake manifold connected in fluid communication with the plurality of cylinders, a first inlet opening formed through the cowl, a first outlet opening formed through the cowl, and a second inlet opening formed through the cowl and connected in fluid communication with the air intake manifold.

In a preferred embodiment of the present invention, the engine is disposed at least partially within the cavity formed by the cowl, the first inlet and first outlet openings define a first flow path which directs a first stream of air from a position external to the cowl and proximate the first inlet opening to a region external to the cowl and proximate the first outlet opening. The first stream of air is directed to flow in thermal communication with the engine and transfer heat from within the cavity to a region external to the cowl and proximate the first outlet opening. The second inlet opening and the air intake manifold define a second flow path which directs a second stream of air from a location external to the cowl and proximate the second inlet opening to the air intake manifold.

In certain embodiments of the present invention, it further comprises a fan disposed within the first flow path and configured to induce the first stream of air to flow from the first inlet opening to the first outlet opening. It can further comprise a baffle disposed within the cavity and shaped to direct the first stream of air toward the fan. In certain preferred embodiments of the present invention, the first and second streams of air are mutually exclusive with no air flowing within both and the first and second flow paths are separate from each other along their entire individual lengths within the cavity defined by the cowl. In certain embodiments of the present invention, it can further comprise a supercharger disposed within the cavity and in fluid communication with the second inlet opening and the air intake manifold. This type of embodiment of the present invention can incorporate a second flow path that extends through the supercharger and the first stream of air can be directed to flow in thermal communication with the supercharger and transfer heat from the supercharger to the region external to the cowl and proximate the first outlet opening. In certain embodiments of the present invention, it can further comprise an air intake cover attached to the cowl and shaped to direct a flow of air into the second inlet opening.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
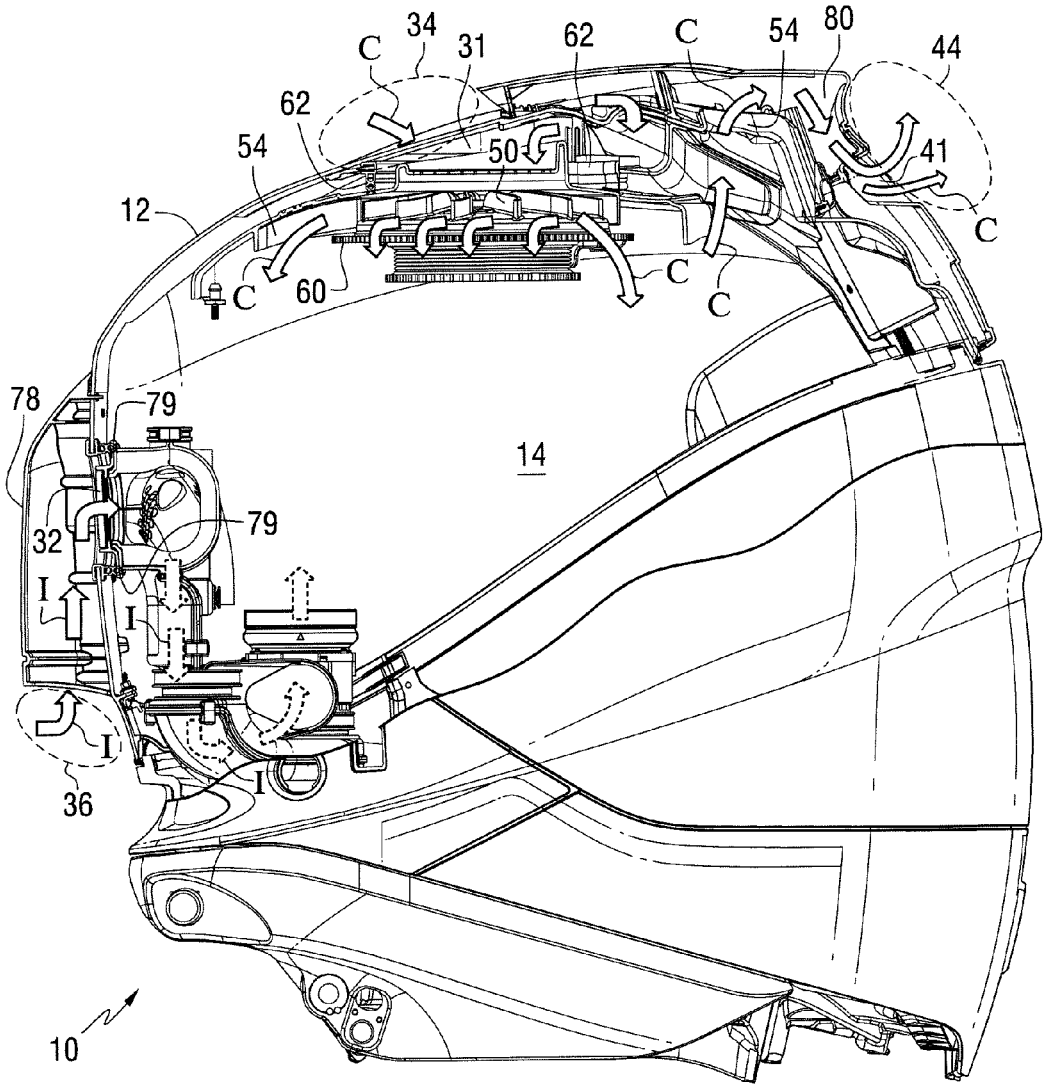
FIG. 1 illustrates the upper portion of an outboard motor, but with no engine under its cowl.

Throughout the description of the preferred embodiment of the present invention, like components will be identified by like reference numerals.

Figure 2:
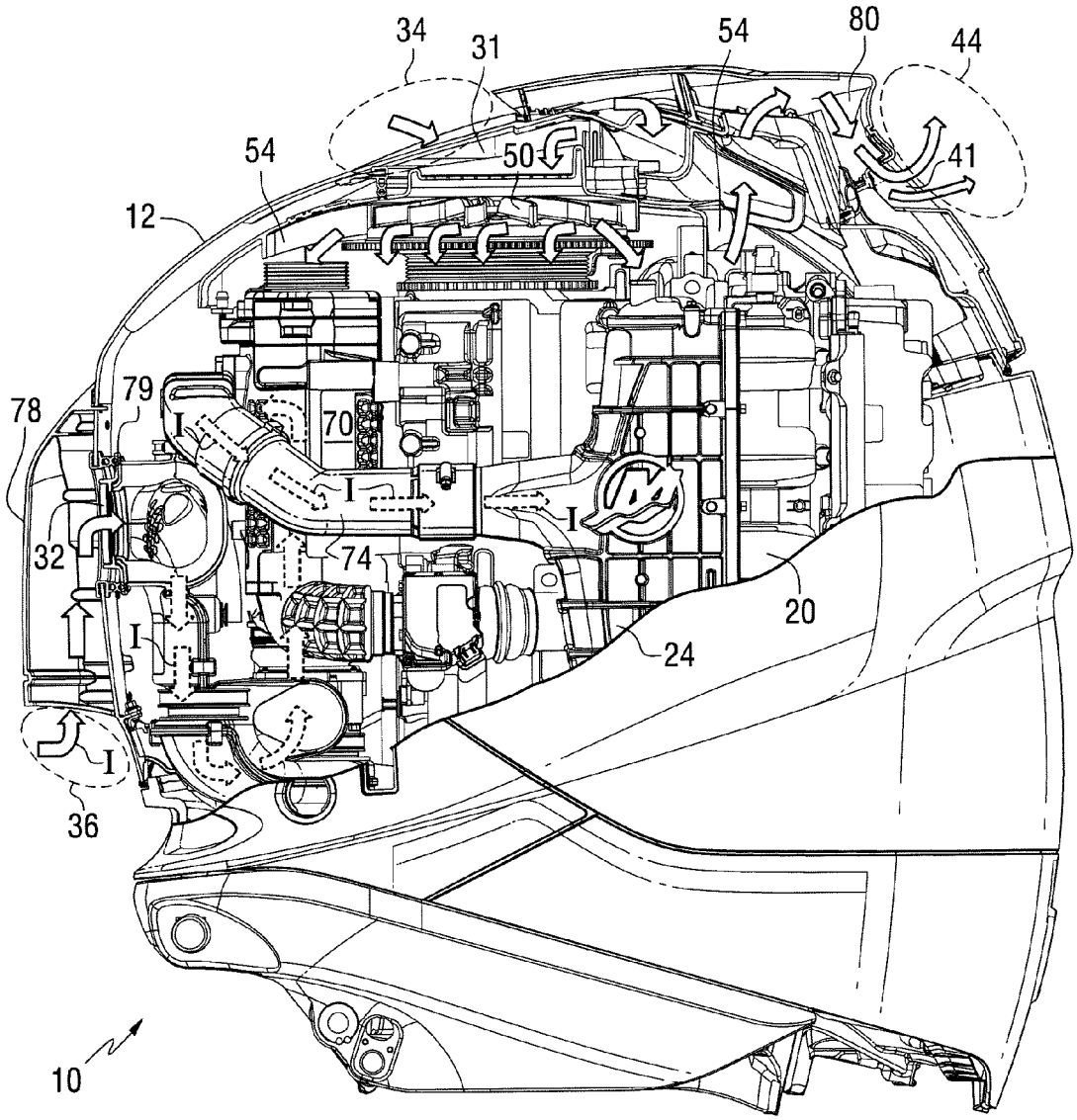
FIG. 2 is similar to FIG. 1, but with an engine illustrated in the cavity defined by the cowl.

FIG. 1 is a partially sectioned view of an outboard motor 10 having a cowl 12 that defines a cavity 14. FIG. 2 shows the outboard motor 10 with an engine 20 disposed within the cavity 14 described above. The engine comprises a plurality of cylinders and is disposed at least partially within the cavity 14 as shown. An air intake manifold 24 is connected in fluid communication with the plurality of cylinders.

Because of the complexity of the internal structure of the outboard motor 10, the preferred embodiment of the present invention will be described in conjunction with simultaneous reference to FIGS. 1 and 2. The air intake manifold 24 directs a flow of air into the plurality of cylinders of the engine 20. A first inlet opening 31 is formed through the cowl 12 and a first outlet opening 41 is also formed through the cowl 12. The first inlet opening 31 and the first outlet opening 41 define a first flow path which is identified by arrows C. The first flow path directs a first stream of air from a position external to the cowl 12 and proximate the first inlet opening 31 to a region external to the cowl 12 and proximate the first outlet opening 41. In FIGS. 1 and 2, these regions are identified by the dashed line ovals, 34 and 44. It should be understood that the use of dashed line ovals for this purpose is intended to merely show the general region outside the cowl 12 from which and toward which the air of the first stream is directed. The first stream of to air, represented by arrows C, is directed to flow in thermal communication with the engine 20 and transfer heat from within the cavity 14 to the region 44 external to the cowl 12 and proximate the first outlet opening 41. A second inlet opening 32 is formed through the cowl 12 and connected in fluid communication with the air intake manifold 24. The second inlet opening 32 and the air intake manifold 24 define a second flow path which is represented by arrows I. The second flow path I directs a second stream of air from a location external to the cowl 12 and proximate the second inlet 32 toward the air intake manifold 24. Dashed line oval 36 represents the general location external to the cowl 12 and proximate the second inlet 32 from which the air is drawn and conducted along the second flow path represented by arrows I.

Figure 3:
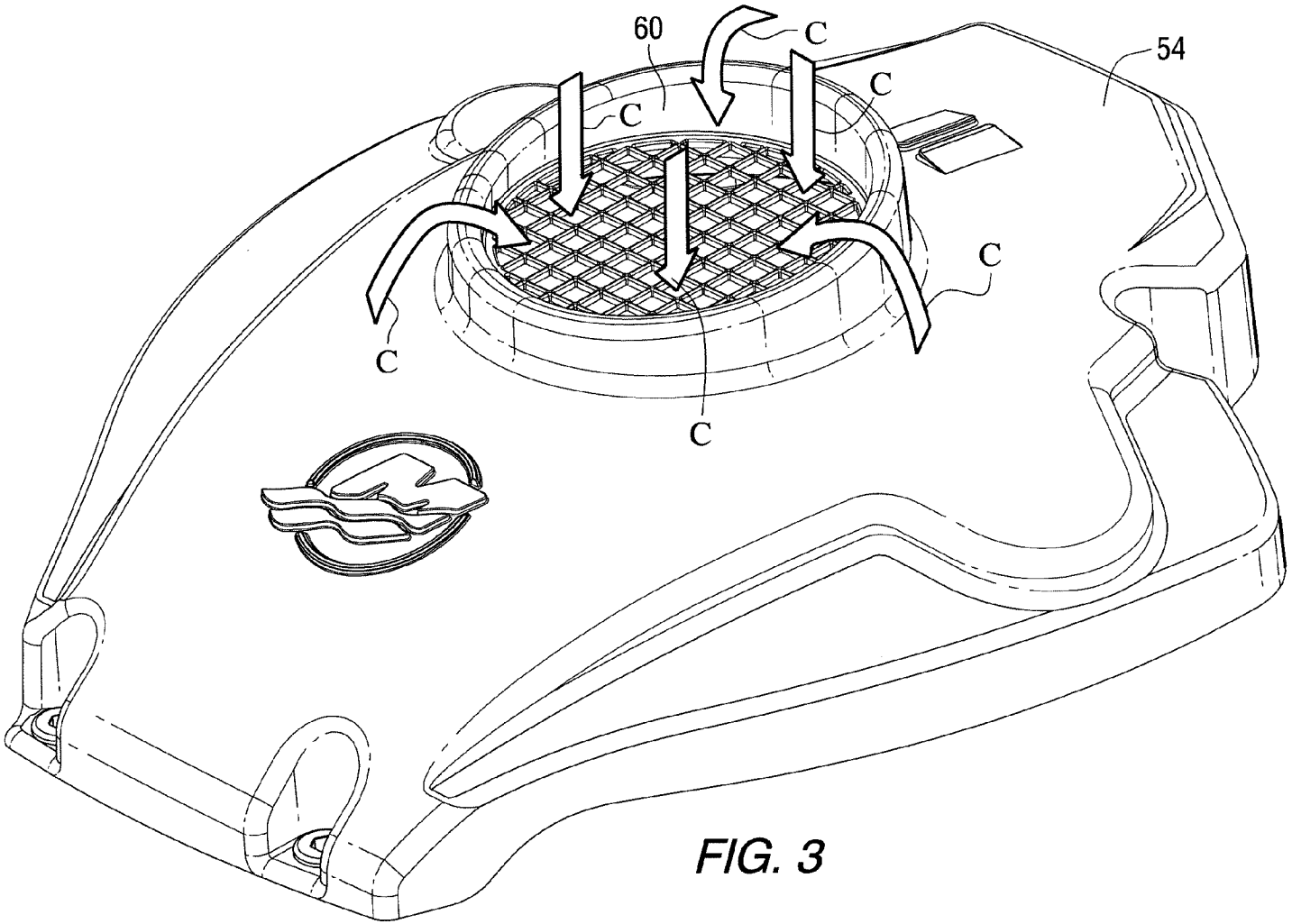
FIG. 3 is an isometric view of a baffle used in a preferred embodiment of the present invention.
Figure 4:
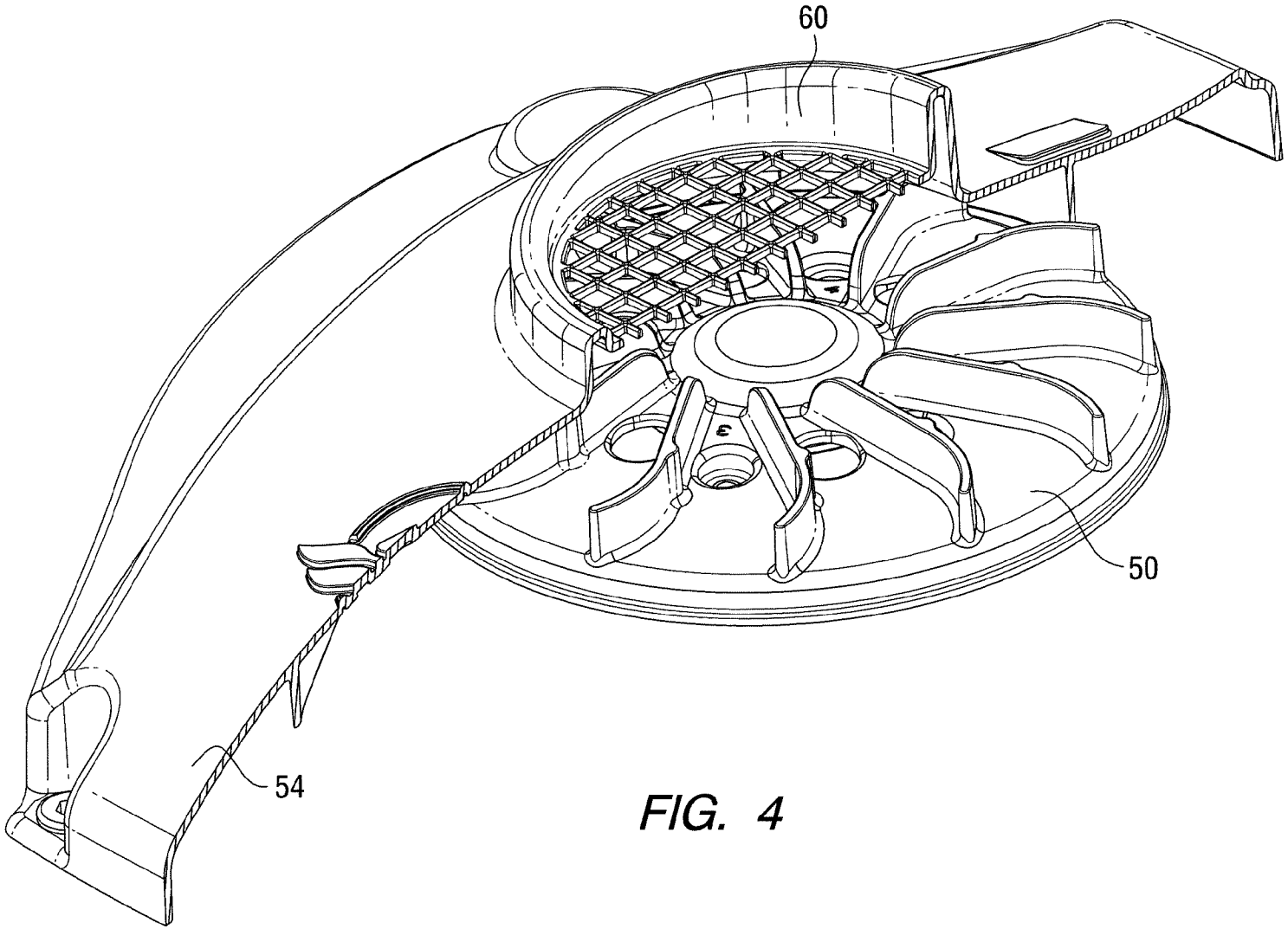
FIG. 4 is a section view of the illustration shown in FIG. 3.

With continued reference to FIGS. 1 and 2, a fan 50 is disposed within the first flow path C and configured to induce the first stream of air to flow from the first inlet opening 31 to the first outlet opening 41. A baffle 54 is disposed within the cavity 14 and shaped to direct the first stream C of air toward the fan 50. FIGS. 3 and 4 show an isometric view and a sectioned isometric view of the baffle 54 and fan 50. The fan 50 is attached to the flywheel 60 of the engine. FIGS. 1 and 2 show the relative positions of the baffle 54, fan 50 and flywheel 60.

With continued reference to FIGS. 1-4, the cooling air is directed through the generally circular opening 60 and induced to flow downwardly over certain heating emitting devices, such as the engine and alternator. As will be described in greater detail below, seals are provided to make sure that the air has no other alternative path other than flowing from the first inlet 31 through the opening 60. A seal 62 prevents air from bypassing the path through the fan 50. It is important that the air flowing into the first inlet opening 31 be directed into the fan because, as will be described in greater detail below, the air would not otherwise be urged to flow in thermal communication with the engine 20. It should be noted that the first and second streams of air, represented by arrows C and I respectively, are mutually exclusive and no air flows within both the first and second streams of air. It is the intention in preferred embodiments of the present invention that the first and second streams of air be isolated from each other. The first and second flow paths are therefore separate from each other along their entire individual length within the cavity 14 under the cowl 12.

With continued reference to FIGS. 1-4, certain embodiments of the present invention further comprise a supercharger 70 that is disposed within the cavity 14 and in fluid communication with the second inlet opening 32 and with the air intake manifold 24. The second flow path I extends through the inner structure of the supercharger and is compressed as it flows from the second inlet opening 32, through the supercharger 70, through the conduit 74, and into the air intake manifold 24. This compression takes place within the supercharger 70 and affects only the air I flowing within the second flow path. The first stream of air C is directed to flow in thermal communication with the supercharger 70 and transfer heat from the supercharger to the region 44 external to the cowl and proximate the first outlet opening 41. In other words, the first stream of air C cools the outer surface of the supercharger 70 while the second stream of air I flows through the internal structure of the supercharger 70 and is compressed prior to flowing into the air intake manifold 24. An air intake cover 78 is attached to the cowl 12 and directs the air from region 36 into the second inlet opening 32. It should be noted that a seal 79 is provided to prevent air from flowing into the second inlet opening 32 from the cavity 14. It is important that this air within the cavity 14, which is used to cool components under the cowl 12, not be conducted into the cylinders of the engine 20.

Figure 5:
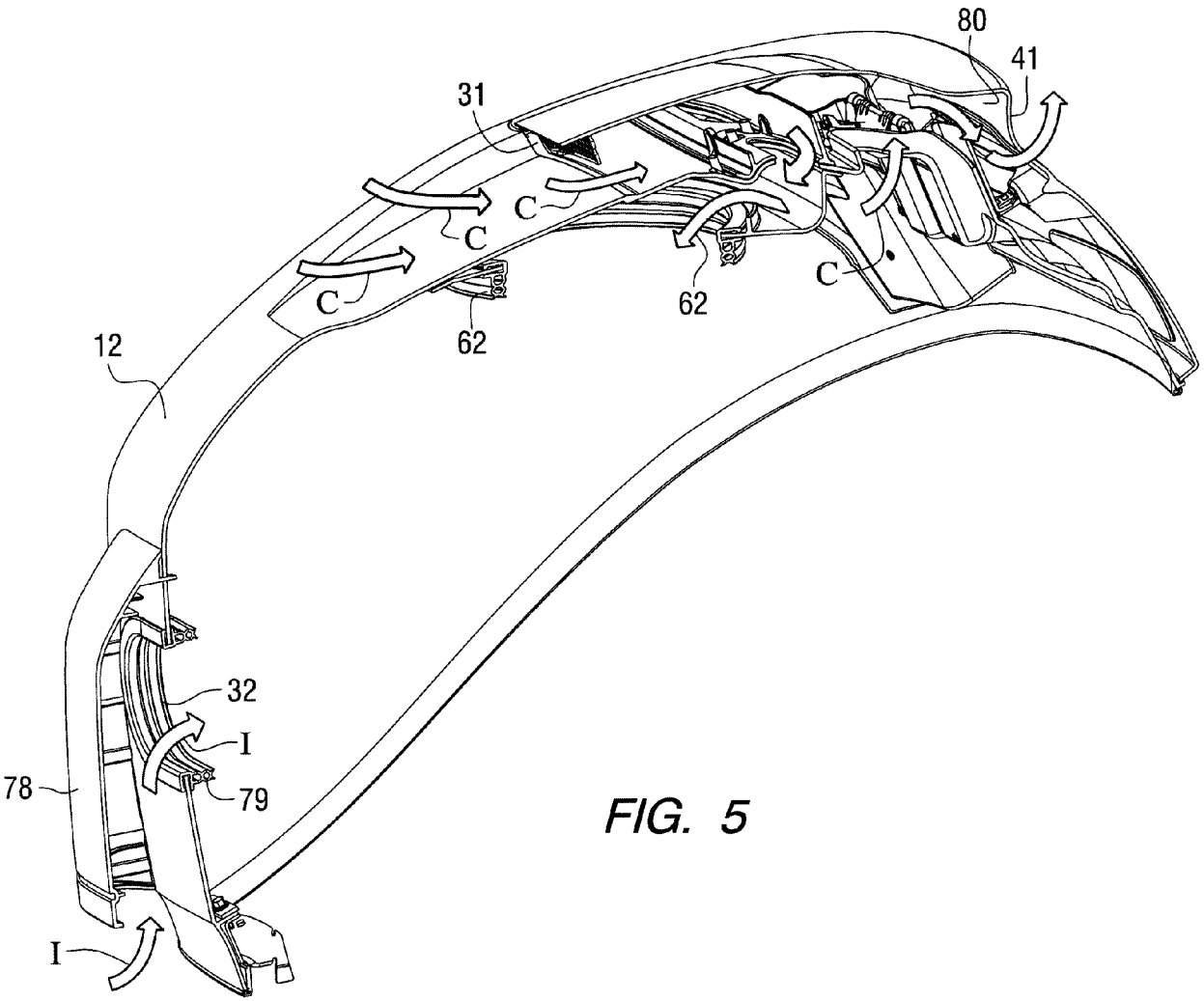
FIG. 5 is a section view of a portion of an upper cowl used in a preferred embodiment of the present invention.

FIG. 5 is a sectioned isometric view of the upper portion of the cowl 12 which is described above in conjunction with FIGS. 1 and 2. The seal 62 is shown in place where it prevents air that flows through the first inlet opening 31 from bypassing opening 60 which is part of the baffle 54 as described above in conjunction with FIGS. 3 and 4. The air of the first flow path C is therefore directed, as represented by arrows C in FIG. 5, from the first inlet opening 31 toward the central portion of the seal 62 and downwardly through the opening 60 of the baffle 54 as described above. After flowing in thermal communication with the engine, alternator, and other heat emitting components under the cowl 12, the air flows upwardly and is directed into the space 80 which then directs it through the first outlet opening 41 through the cowl 12. Along its entire path, the air of the first flow path C does not mix with the air of the second flow path I. Therefore, the cooling air C of the first stream of air is not used in the combustion process by the engine 20 after it is heated because of its function of reducing the temperature and removing heat from heat emitting components under the cowl 12.

With continued reference to FIG. 5, the air which is intended to be inducted into the cylinders of the engine is conducted through the second inlet opening 32 and directed into the second inlet opening 32 by the air intake cover 78 which is attached to the cowl 12. The seal 79 is provided to assure that only air of the second stream of air I is conducted into the supercharger and, eventually, into the cylinders of the engine 20.

It should be noted that one important feature of a preferred embodiment of the present invention is that it provides two streams of air that are isolated from each other. Several characteristics of the preferred embodiment of the present invention are provided for the purpose of assuring this isolation and avoiding any air from either stream of air flowing into or with the other stream of air. In other words, none of the cooling air C of the first stream of air is conducted into the cylinders of the engine 20. Likewise, none of the inducted air I of the second stream of air is obtained from the cavity 14 under the cowl that has been heated by thermal communication with heat emitting components under the cowl.

With continued reference to FIGS. 1-5, it should be understood that the first stream of air C flows into the first inlet opening 31, through opening 60 of the baffle 54, downwardly through the fan 50 that urges it to flow over the engine, alternator and other heat emitting components, into the space 80, and out of the first outlet opening 41 formed in the cowl 12. The completely separate second stream of air I is directed by the air intake cover 78 into and through the second inlet opening 32, into and through the heat exchanger 70, through conduit 74, into the air intake manifold 24, and into the cylinders of the engine 20 where the combustion process takes place. After the combustion process is complete, this air flows out of the exhaust pipe of the engine. The first stream of air C does not mix with the second stream of air I. As a result, the second stream of air I is not heated by thermal communication with heat emitting components and, as a result, remains cooler and in a more dense state than would otherwise be the case. This improves the efficiency of the engine operation and increases power available from the engine 20 because of the higher mass air flow provided through the use of induction air that is not heated in that way.

With continued reference to FIGS. 1-5, it can be seen that a marine propulsion device made in accordance with a preferred embodiment of the present invention comprises a cowl 12 defining a cavity 14, an engine 20 having a plurality of cylinders wherein the engine 20 is disposed at least partially within the cavity 14, an air intake manifold 24 connected in fluid communication with the plurality of cylinders, a first inlet opening 31 formed through the cowl 12, a first outlet opening 41 formed through the cowl 12 wherein the first inlet and first outlet openings, 31 and 41, define a first flow path C which directs a first stream of air from a position 34 external to the cowl 12 and proximate the first inlet opening 31 to a region 44 external to the cowl 12 and proximate the first outlet opening 41. This first stream of air C is directed to flow in thermal communication with the engine 20 and transfer heat from the cavity 14 to the region 44 external the cowl 12 and proximate the first outlet opening 41. In a preferred embodiment of the present invention, a second inlet opening 32 is formed through the cowl 12 and connected in fluid communication with the air intake manifold 24. The second inlet opening 32 and the air intake manifold 24 define a second flow path I which directs a second stream of air from a location 36 external to the cowl 12 and proximate the second inlet opening 32 toward the air intake manifold 24. Certain embodiments of the present invention further comprise a fan 50 disposed within the first flow path C and configured to induce the first stream of air to flow from the first inlet opening 31 to the first outlet opening 41. A baffle 54 is disposed within the cavity 14 under the cowl 12 and is shaped to direct the first stream of air C toward the fan 50. A supercharger 70 is disposed within the cavity 14 and in fluid communication with the second inlet opening 32 and with the air intake manifold 24. The second flow path I extends through the supercharger 70 and the first stream of air C is directed to flow in thermal communication with an outside surface of the supercharger in order transfer heat from the supercharger 70 to the region 44 external to the cowl 12 and proximate the first outlet opening 41. The first and second streams of air, C and I, are mutually exclusive with no air flowing within both the first and second streams. The first and second flow paths are separate from each other along their entire individual lengths within the cavity 14 under the cowl 12. The air intake cover 78 is attached to the cowl 12 and shaped to direct the flow of air into the second inlet opening 32.

Several characteristics of the preferred embodiments of the present invention should be understood in order to fully appreciate its advantages. First, in most outboard motors, the reciprocal operation of the pistons within the cylinders of the engine act as an air pump in order to create a vacuum within the air intake manifold and induce air flow into the engine. This behavior of the engine, when it acts as an air pump, is the primary reason that air is drawn into the region under the cowl and caused to flow in thermal communication with components of the outboard motor. Without the engine acting as an air pump, or some alternative inducement to cause to flow under the cowl, very little reason would exist for the air to flow in thermal communication with the components of the outboard motor. Since the preferred embodiments of the present invention provide a distinct second air path from the second inlet opening 32 directly to the air intake manifold 24, the engine 20 would be prevented from acting as the air pump and thereby drawing air through the first inlet opening 31. Although the reciprocation of the pistons within the cylinders of the engine 20 would induce the flow of air into the second inlet opening 32 and into the cylinders of the engine, that reciprocation of the pistons would not induce a flow of air into the cavity 14 and in thermal communication with the outside surfaces of heat emitting components disposed under the cowl 12. Therefore, it is important that a fan 50 and baffle 54 be provided in order to induce the flow of air along the first air paths identified by arrows C.

With continued reference to FIGS. 1-5, it should be understood that other components under the cowl 12 which do not directly relate to the present invention are not described in detail herein. As an example, directly below conduit 74, a bypass conduit directs a flow of air from the air intake manifold 24 back to the supercharger 70 in order to account for a situation when more air is compressed by the supercharger than is needed by the cylinders of the engine 20. The specific types of heat emitting components that are cooled by the first stream of air C should not be considered to be limiting to the scope of the present invention. The flow of air through the cavity 14 is intended to flow in thermal communication with all heat emitting components along its path so that the heat can be carried away from those components and out of the cavity 14 by flowing through the first outlet opening 41 into the region 44 outside the cowl 12. In summary, two completely independent and isolated air streams are provided to perform two distinctly different functions. The first function, that of cooling components under the cowl 12, is performed by the first stream of air C. The second function, relating to the provision of air into the cylinders of the engine 20, is provided by the second stream of air I. These streams are not mixed with each other but, instead, are maintained in isolation from each other so that they can each perform their individual functions without interfering with the functions of the other stream.

Although the present invention has been described with particular detail and illustrated to show its preferred embodiments, it should be understood that alternative embodiments are also within its scope.

We claim:

1. A marine propulsion device, comprising:

a cowl defining a cavity;

an engine having a plurality of cylinders, said engine being disposed at least partially within said cavity;

an air intake manifold connected in fluid communication with said plurality of cylinders;

a first inlet opening formed through said cowl;

a first outlet opening formed through said cowl, said first inlet and first outlet openings defining a first flow path which directs a first stream of air from a position external to said cowl and proximate said first inlet opening to a region external to said cowl and proximate said first outlet opening, said first stream of air being directed to flow in thermal communication with said engine and transfer heat from within said cavity to said region external to said cowl and proximate said first outlet opening; and a second inlet opening formed through said cowl and connected in fluid communication with said air intake manifold, said second inlet opening and said air intake manifold defining a second flow path which directs a second stream of air from a location external to said cowl and proximate said second inlet opening to said air intake manifold, wherein said first and second streams of air are mutually exclusive with no air flowing within both of said first and second streams of air.

2. A marine propulsion device, comprising:

a cowl defining a cavity;

an engine having a plurality of cylinders, said engine being disposed at least partially within said cavity;

an air intake manifold connected in fluid communication with said plurality of cylinders;

a first inlet opening formed through said cowl;

a first outlet opening formed through said cowl, said first inlet and first outlet openings defining a first flow path which directs a first stream of air from a position external to said cowl and proximate said first inlet opening to a region external to said cowl and proximate said first outlet opening, said first stream of air being directed to flow in thermal communication with said engine and transfer heat from within said cavity to said region external to said cowl and proximate said first outlet opening; and a second inlet opening formed through said cowl and connected in fluid communication with said air intake manifold, said second inlet opening and said air intake manifold defining a second flow path which directs a second stream of air from a location external to said cowl and proximate said second inlet opening to said air intake manifold, wherein said first and second flow paths are separate from each other along their entire individual lengths within said cavity.

3. A marine propulsion device, comprising:

a cowl defining a cavity;

an engine having a plurality of cylinders, said engine being disposed at least partially within said cavity;

an air intake manifold connected in fluid communication with said plurality of cylinders;

a first inlet opening formed through said cowl;

a first outlet opening formed through said cowl, said first inlet and first outlet openings defining a first flow path which directs a first stream of air from a position external to said cowl and proximate said first inlet opening to a region external to said cowl and proximate said first outlet opening, said first stream of air being directed to flow in thermal communication with said engine and transfer heat from within said cavity to said region external to said cowl and proximate said first outlet opening;

a second inlet opening formed through said cowl and connected in fluid communication with said air intake manifold, said second inlet opening and said air intake manifold defining a second flow path which directs a second stream of air from a location external to said cowl and proximate said second inlet opening to said air intake manifold; and a supercharger disposed within said cavity and in fluid communication with said second inlet opening and said air intake manifold.

4. The propulsion device of claim 3, wherein:

said second flow path extends through said supercharger.

5. The propulsion device of claim 3, wherein:

said first stream of air is directed to flow in thermal communication with said supercharger and transfer heat from said supercharger to said region external to said cowl and proximate said first outlet opening.

6. A marine propulsion device, comprising:

a cowl defining a cavity;

an engine having a plurality of cylinders, said engine being disposed at least partially within said cavity;

an air intake manifold connected in fluid communication with said plurality of cylinders;

a first inlet opening formed through said cowl;

a first outlet opening formed through said cowl, said first inlet and first outlet openings defining a first flow path which directs a first stream of air from a position external to said cowl and proximate said first inlet opening to a region external to said cowl and proximate said first outlet opening, said first stream of air being directed to flow in thermal communication with said engine and transfer heat from within said cavity to said region external to said cowl and proximate said first outlet opening;

a second inlet opening formed through said cowl and connected in fluid communication with said air intake manifold, said second inlet opening and said air intake manifold defining a second flow path which directs a second stream of air from a location external to said cowl and proximate said second inlet opening to said air intake manifold, said first and second streams of air being mutually exclusive with no air flowing within both of said first and second streams of air; and a fan disposed within said first flow path and configured to induce said first stream of air to flow from said first inlet opening to said first outlet opening.

7. The propulsion device of claim 6, further comprising:

a baffle disposed within said cavity and shaped to direct said first stream of air toward said fan.

8. The propulsion device of claim 6, wherein:

said first and second flow paths are separate from each other along their entire individual lengths within said cavity.

9. The propulsion device of claim 6, further comprising:

a supercharger disposed within said cavity and in fluid communication with said second inlet opening and said air intake manifold, said second flow path extending through said supercharger.

10. The propulsion device of claim 9, wherein:

said first stream of air is directed to flow in thermal communication with said supercharger and transfer heat from said supercharger to said region external to said cowl and proximate said first outlet opening.

11. The propulsion device of claim 6, further comprising:

an air intake cover attached to said cowl and shaped to direct a flow of air into said second inlet opening.

12. A marine propulsion device, comprising:

a cowl defining a cavity;

an engine having a plurality of cylinders, said engine being disposed at least partially within said cavity;

an air intake manifold connected in fluid communication with said plurality of cylinders;

a first inlet opening formed through said cowl;

a first outlet opening formed through said cowl, said first inlet and first outlet openings defining a first flow path which directs a first stream of air from a position external to said cowl and proximate said first inlet opening to a region external to said cowl and proximate said first outlet opening, said first stream of air being directed to flow in thermal communication with said engine and transfer heat from within said cavity to said region external to said cowl and proximate said first outlet opening;

a second inlet opening formed through said cowl and connected in fluid communication with said air intake manifold, said second inlet opening and said air intake manifold defining a second flow path which directs a second stream of air from a location external to said cowl and proximate said second inlet opening to said air intake manifold;

a fan disposed within said first flow path and configured to induce said first stream of air to flow from said first inlet opening to said first outlet opening;

a baffle disposed within said cavity and shaped to direct said first stream of air toward said fan; and a supercharger disposed within said cavity and in fluid communication with said second inlet opening and said air intake manifold, said second flow path extending through said supercharger, said first stream of air is directed to flow in thermal communication with said supercharger and transfer heat from said supercharger to said region external to said cowl and proximate said first outlet opening.

13. The propulsion device of claim 12, wherein:

said first and second streams of air are mutually exclusive with no air flowing within both of said first and second streams of air.

14. The propulsion device of claim 12, wherein:

said first and second flow paths are separate from each other along their entire individual lengths within said cavity.

15. The propulsion device of claim 12, further comprising:

an air intake cover attached to said cowl and shaped to direct a flow of air into said second inlet opening.

* * * * *